US006451087B2

(12) United States Patent
Bizen et al.

(10) Patent No.: US 6,451,087 B2
(45) Date of Patent: Sep. 17, 2002

(54) METHOD FOR PRODUCING MOTHER ALLOYS FOR IRON-BASED AMORPHOUS ALLOYS

(75) Inventors: Yoshio Bizen; Setsuo Mishima, both of Shimane-ken; Takashi Meguro, Tottori-ken, all of (JP)

(73) Assignee: Hitachi Metals Ltd., Tokyo (JP)

( * ) Notice: Subject to any disclaimer, the term of this patent is extended or adjusted under 35 U.S.C. 154(b) by 0 days.

(21) Appl. No.: 09/852,634

(22) Filed: May 11, 2001

(30) Foreign Application Priority Data

May 11, 2000 (JP) ..... 2000-138128

(51) Int. Cl.[7] ..... C22C 33/04
(52) U.S. Cl. ..... 75/560; 420/590
(58) Field of Search ..... 75/560; 420/590

(56) References Cited

U.S. PATENT DOCUMENTS 4,999,053 A * 3/1991 Ototani et al. ..... 420/129

FOREIGN PATENT DOCUMENTS

JP 58011708 A * 1/1983 ..... 75/10.63
JP 61284517 A * 12/1986 ..... C21C/7/064
JP 05171341 A * 7/1993 ..... C22C/33/04
JP 07242985 A * 9/1995 ..... C22C/33/04

OTHER PUBLICATIONS

Derwent Acc. No. 1985–162255 for JP 60092417 A issued May 24, 1985. Japan Metals and Chem Co Ltd. Abstract only.*

* cited by examiner

*Primary Examiner*—Roy King
*Assistant Examiner*—Tima McGuthry-Banks
(74) *Attorney, Agent, or Firm*—Sughrue Mion, PLLC

(57) ABSTRACT

The method for producing a mother alloy for an iron-based amorphous alloy has the steps of (a) melting raw materials for elements constituting the amorphous alloy together with at least one oxide of an element constituting the amorphous alloy, the raw materials containing aluminum as an inevitable impurity, and the oxide having a smaller standard free energy of formation than that of $Al_2O_3$ in an absolute value; and (b) removing the resultant $Al_2O_3$ from the melt, thereby reducing the content of aluminum to 50 ppm or less in the melt.

10 Claims, No Drawings

METHOD FOR PRODUCING MOTHER ALLOYS FOR IRON-BASED AMORPHOUS ALLOYS

FIELD OF THE INVENTION

The present invention relates to a method for producing a mother alloy for an iron-based amorphous alloy containing a sufficiently small amount of Al, which is harmful to the surface conditions and toughness of the amorphous alloy.

BACKGROUND OF THE INVENTION

Amorphous alloy ribbons are widely used for cores for transformers, choke coils, etc. Nanocrystalline alloy ribbons having microstructures having crystal grain sizes of several tens of nanometers are also widely used for various magnetic parts because of their excellent soft magnetic properties. The nanocrystalline alloy ribbons are produced by heat-treating the amorphous alloy ribbons.

These magnetic alloy ribbons are generally produced by melt-quenching methods such as a single-roller method, a double-roller method, etc. and wound to form toroidal magnetic cores. The details of the melt-quenching methods are described in the chapter of "Melt-Quenching Method" in Masumoto, et. al., "Amorphous Alloys." For instance, the single-roller method is a method of ejecting a molten alloy onto a rapidly rotating cooling roller, so that the molten alloy is quenched to continuously form a ribbon.

Iron-based magnetic alloys having various compositions have been developed depending on their applications. Among them, iron-based magnetic alloys containing Nb are known to have excellent soft magnetic properties. For instance, Japanese Patent Publication No. 60-38454 discloses amorphous Fe—Nb—Si—B alloys having excellent effective magnetic permeability. As described in Japanese Patent Publication No. 4-4393, nanocrystalline, magnetic Fe—Cu—Nb—Si—B alloys have excellent soft magnetic properties. Nb functions as an element for decreasing a magnetostriction to improve soft magnetic properties in the amorphous alloys, and an element effective for making crystal grains finer in the nanocrystalline alloys. In these soft magnetic alloys containing Nb, high-purity Nb has conventionally been used as a raw material, because high-purity Nb contains small amounts of impurity elements such as Al harmful to magnetic properties and toughness of the amorphous alloys. However, because the high-purity Nb is extremely expensive as a raw material, it makes the production cost of alloy ribbons higher.

From the industrial point of view, ferroniobium is preferable, because it is as cheap as 1/10 of the high-purity Nb. However, the ferroniobium contains impurity elements, particularly Al in an amount of about 0.1–2 mass %, because the ferroniobium is produced by a Thermit method. The Thermit method is a refining method using fine Al powder for reducing metal oxides such as $Nb_2O_5$. Thus, there remains a relatively large amount of Al in ferroalloys (iron alloys) such as ferroniobium produced by the Thermit method.

Al contained as an impurity is oxidized to $Al_2O_3$ during melting. In the case of producing an amorphous alloy ribbon by a single-roller method, a slag or inclusion based on $Al_2O_3$ are accumulated in a nozzle for ejecting a molten alloy, resulting in streaks on the ribbon surface in its longitudinal direction. If there were streaks on the surface of the ribbon, a toroidal coil formed from the ribbon would have a low packing factor because of surface roughness, resulting in failure to the miniaturization of the toroidal coil and extremely poor magnetic properties. Also, because $Al_2O_3$ remains as a non-metallic inclusion in the alloy ribbon, the ribbon is brittle, because the non-metallic inclusion acts as sites for fracture. If the ribbon were brittle, it would be cut when wound to a toroidal coil, resulting in extremely disturbed processes and poor yield.

OBJECT OF THE INVENTION

Accordingly, an object of the present invention is to provide a method for producing a mother alloy suitable for iron-based amorphous alloys having a low Al content, capable of providing amorphous alloy ribbons with excellent magnetic properties free from streaks and brittleness, even when inexpensive ferroalloys such as ferroniobium containing a relatively large amount of Al are used as raw materials.

DISCLOSURE OF THE INVENTION

The method for producing a mother alloy for an iron-based amorphous alloy according to one embodiment of the present invention comprises the steps of (a) melting raw materials for elements constituting the amorphous alloy together with at least one oxide of an element constituting the amorphous alloy, the raw materials containing aluminum as an inevitable impurity, and the oxide having a smaller standard free energy of formation than that of $Al_2O_3$ in an absolute value; and (b) removing the resultant $Al_2O_3$ from the melt, thereby reducing the content of aluminum to 50 ppm or less in the melt.

The method for producing a mother alloy for an iron-based amorphous alloy according to another embodiment of the present invention comprises the steps of (a) melting raw materials for elements constituting the amorphous alloy to form a melt, the raw materials containing aluminum as an inevitable impurity; (b) blowing an oxygen-based gas into or onto the melt; and (c) removing the resultant $Al_2O_3$ from the melt, thereby reducing the content of aluminum to 50 ppm or less in the melt. In the method according to another embodiment of the present invention, at least one oxide of an element constituting the amorphous alloy is preferably used together with the raw materials for elements constituting the amorphous alloy, the oxide having a smaller standard free energy of formation than that of $Al_2O_3$ in an absolute value.

Ferroniobium is preferably used as one of raw materials for elements constituting the amorphous alloy. The oxide of an element constituting the amorphous alloy is preferably at least one of iron oxide, copper oxide, silicon oxide and boron oxide, more preferably iron oxide ($Fe_2O_3$).

DESCRIPTION OF THE PREFERRED EMBODIMENTS

One of the important features of the present invention is to use at least one oxide of an element constituting the amorphous alloy, which has a smaller standard free energy of formation than that of $Al_2O_3$ in an absolute value. The standard free energy of formation of a substance is defined as the free energy increase of the reaction in a standard state at 25° C., in which the substance is formed from elements. The standard free energies of formation are described, for instance, in the column of "Standard Free Energies of Formation for Oxides" in "Metal Data Book," edited by the Japan Institute of Metals, and in the figures of standard free energies of formation for oxides in "New Lecture on Metallurgy, Nonferrous Metal Refining" of the Japan Institute of Metals.

For instance, when ferroalloys such as ferroniobium and ferroboron, which contain a relatively large amount of Al, are combined with $Fe_2O_3$, one of the oxides having a smaller standard free energy of formation than that of $Al_2O_3$ in an absolute value, $Fe_2O_3$ is reduced to iron, a main element constituting the iron-based amorphous alloy, by the oxidation-reduction reaction of $Fe_2O_3+2Al=Al_2O_3+2Fe$. On the other hand, Al contained as an inevitable impurity in the ferroalloys are oxidized to $Al_2O_3$, which floats as a slag on a surface of the resultant melt. By removing $Al_2O_3$, the melt is purified, with a reduced amount of Al harmful to the surface conditions and toughness of an amorphous alloy ribbon, which is to be formed from the mother alloy. Metal elements formed as by-products of $Al_2O_3$ can be used as elements for constituting the amorphous alloy. For instance, Fe formed from $Fe_2O_3$ by the above oxidation-reduction reaction constitutes a main element for the iron-based amorphous alloy.

Oxides usable in the present invention are iron oxide, copper oxide, silicon oxide and boron oxide. The iron oxide may be $Fe_2O_3$, FeO, $Fe_3O_4$ or mixtures thereof. The copper oxide may be CuO, $Cu_2O$ or mixtures thereof. The silicon oxide may be $SiO_2$, and the boron oxide may be $B_2O_3$.

The amount of the oxide added to the melt may be adjusted depending on the Al contents in the raw materials. In practice, the amount of the oxide added is preferably 0.005–1 mass %, more preferably 0.01–0.5 mass % based on the melt. The oxide may be introduced simultaneously with or after adding the raw materials for amorphous alloy-constituting elements.

Another feature of the present invention is to use ferroalloys such as ferroniobium and ferroboron. In the case of an iron-based amorphous alloy containing Nb as an indispensable element, inexpensive ferroniobium may be used. A commercially available ferroniobium contains 0.1–2 mass % of aluminum. The present invention is effective particularly when such Al-containing, commercially available ferroniobium is used. Even with such inexpensive raw materials, the method of the present invention can produce amorphous alloy ribbons free from streaks and brittleness.

A further feature of the present invention is that the iron-based amorphous alloy contains 50 ppm or less of Al. When the Al content in the iron-based amorphous alloy exceeds 50 ppm, the iron-based amorphous alloy suffers from surface streaks and brittleness. Incidentally, the reduction of the Al content to less than 5 ppm results in a higher production cost. Therefore, the lower limit of the Al content in the iron-based amorphous alloy is about 5 ppm from the industrial point of view.

In another aspect of the present invention, an oxygen-based gas is blown into or onto the melt for the iron-based amorphous alloy, to form $Al_2O_3$, which should be removed. The way of blowing the oxygen-based gas is not restrictive. The oxygen-based gas may be blown from above the melt, or blown into the melt via a lance.

The oxygen-based gas comprises oxygen as a mainly component. Accordingly, it is not only pure oxygen, but also may be an oxygen-based, mixed gas containing inert gases such as argon and helium. The air may be used as the oxygen-based gas.

It should be noted that the blowing of an oxygen-based gas may be combined with the addition of at least one oxide of an element constituting the amorphous alloy, which has a smaller standard free energy of formation than that of $Al_2O_3$ in an absolute value.

The amorphous alloy ribbon may be produced by any known methods, for instance, melt-quenching methods such as a single-roller method, a double-roller method, etc. The production of the amorphous alloy ribbon may be carried out in an atmosphere of the air or an inert gas or in vacuum.

The amorphous alloy ribbon produced according to the present invention may have a thickness of about 5–100 $\mu$m and a width of about 1–300 mm.

The iron-based amorphous alloys may have compositions of Fe—Nb—Si—B, Fe—Ni—Nb—Si—B, etc., and the iron-based nanocrystalline alloys obtained by heat-treating the corresponding amorphous alloys at temperatures higher than their crystallization temperatures may have compositions of Fe—Cu—Nb—Si—B, Fe—Zr—Nb—B, Fe—Nb—B, etc., which can provide nanocrystalline structures of several tens of nanometers in crystal grain size. Particularly in the case of the iron-based amorphous alloys containing Nb as an indispensable element, inexpensive ferroniobium containing Al as an impurity element is preferably used because Al can be removed in the form of $Al_2O_3$. In the other ferroalloys containing no Nb, such as ferroboron, the present invention is effective because Al inevitably contained therein can be removed in the form of $Al_2O_3$.

The preferred examples of the compositions of the iron-based amorphous alloys are $Fe_{bal}Nb_{0.1\text{-}30}Si_{0.1\text{-}30}B_{1\text{-}25}$, $Fe_{bal}Ni_{0.1\text{-}30}Nb_{0.1\text{-}30}Si_{0.1\text{-}30}B_{1\text{-}25}$. The preferred examples of the compositions of the iron-based, nanocrystalline alloys are $Fe_{bal}Cu_{0.1\text{-}0.3}Nb_{0.1\text{-}30}Si_{0.1\text{-}30}B_{1\text{-}25}$, $Fe_{bal}Zr_{0.1\text{-}30}Nb_{0.1\text{-}30}B_{1\text{-}25}$, and $Fe_{bal}Nb_{0.1\text{-}30}B_{1\text{-}25}$.

The present invention will be described in detail referring to EXAMPLES below without intention of limiting the present invention thereto.

EXAMPLES 1–6,

Comparative Examples 1–5

Raw materials comprising electrolytic iron, scrap copper, scrap silicon, ferroniobium containing 64 mass % of Nb and different amounts of Al as shown in Table 1, ferroboron containing 18 mass % of Nb and 0.06 mass % of Al, and $Fe_2O_3$ were formulated to a composition comprising 1 atomic % of Cu, 3 atomic % of Nb, 15.5 atomic % of Si, and 6.5 atomic % of B, the balance being substantially Fe and inevitable impurities, and melted in a crucible by induction heating to form a mother alloy melt. This alloy has a composition capable of forming a nanocrystalline structure having an average crystal grain size of about 10 nm. The amount of $Fe_2O_3$ based on the melt was adjusted as shown in Table 1, depending on the amount of Al in ferroniobium. After removing $Al_2O_3$ formed during melting and floating on a melt, an alloy melt was poured into a mold to form a mother alloy.

As COMPARATIVE EXAMPLES 1–5, mother alloys were prepared by using ferroniobium raw materials as shown in Table 1 without adding $Fe_2O_3$.

Each mother alloy melt was formed into an amorphous ribbon by using a single-roller quenching apparatus. Each mother alloy was introduced into a crucible to melt it by a high-frequency induction heating, and the resultant mother alloy melt was ejected through a nozzle having a rectangular slit onto a cooling roller made of a copper alloy, thereby rapidly solidifying it to form an amorphous ribbon of 25 mm in width and 18 $\mu$m in thickness.

The X-ray diffraction of the resultant ribbons revealed that all ribbons were constituted substantially only by an amorphous phase. Measurement was carried out with respect to the amount of Al in each mother alloy prepared, the presence of streaks on each ribbon of an iron-based amorphous alloy produced by a single-roller method, and the streaks and brittleness of each ribbon measured by a tearing test.

The tearing test was carried out by tearing an amorphous ribbon in a transverse direction (perpendicular to a longitudinal direction) at 20 points along the longitudinal direction of the ribbon at the same interval, and calculating a percentage of the torn points to the total points (20). For instance, the ribbon was torn at three point among 20 tested points because of brittleness in COMPARATIVE EXAMPLE 1, indicating that the brittleness expressed by percentage were 3/20=15%.

The results are shown in Table 1.

TABLE 1

| No. | Al Content in Ferroniobium (mass %) | Al in Mother Alloy (ppm) | $Fe_2O_3$ Added (mass %) | Appearance of Amorphous Ribbon | Brittleness[(1)] of Amorphous Ribbon (%) |
|---|---|---|---|---|---|
| EXAMPLE 1 | 0.13 | 5 | 0.005 | No streaks | 0 |
| EXAMPLE 2 | 0.64 | 10 | 0.01 | No streaks | 0 |
| EXAMPLE 3 | 1.01 | 15 | 0.20 | No streaks | 0 |
| EXAMPLE 4 | 1.44 | 20 | 0.50 | No streaks | 0 |
| EXAMPLE 5 | 1.98 | 30 | 0.70 | No streaks | 0 |
| EXAMPLE 6 | 2.5 | 50 | 1.0 | No streaks | 0 |
| COM. EX. 1 | 0.13 | 60 | 0 | With streaks | 15 |
| COM. EX. 2 | 0.64 | 80 | 0 | With streaks | 25 |
| COM. EX. 3 | 1.01 | 100 | 0 | With streaks | 85 |
| COM. EX. 4 | 1.44 | 100 | 0 | With streaks | 95 |
| COM. EX. 5 | 1.98 | 120 | 0 | With streaks | 100 |

Note:
[(1)]Expressed by a percentage of the torn points to the total points (20).

All of the amorphous alloy ribbons formed from mother alloys prepared without adding iron oxide had an Al content exceeding 50 ppm, with streaks on the surface and high brittleness. On the other hand, the amorphous alloy ribbons of the present invention had an Al content of 50 ppm or less, without streaks and brittleness at all.

EXAMPLES 7–11

Raw materials comprising electrolytic iron, scrap copper, granular zirconium, ferroniobium containing 65 mass % of Nb and 0.72 mass % of Al, ferroboron containing 18 mass % of B and 0.09 mass % of Al, and $Fe_2O_3$ were formulated to have a composition shown in Table 2 and melted in a crucible by induction heating to provide mother alloys. All of these alloys had compositions capable of having a nanocrystalline structure in which crystal grain sizes were about 10 nm. The amount of $Fe_2O_3$ added was 0.1 mass % based on the melt. The resultant melt was poured into a mold after removing a slag based on $Al_2O_3$ floating on the melt, to form a mother alloy.

Each mother alloy melt was formed into a ribbon by using a single-roller quenching apparatus. Each mother alloy was introduced into a crucible to melt it by a high-frequency induction heating, and the resultant mother alloy melt was ejected through a nozzle having a rectangular slit onto a cooling roller made of a copper alloy, thereby rapidly solidifying it to form a ribbon of 50 mm in width and 20 $\mu$m in thickness. The X-ray diffraction of the resultant ribbons revealed that all ribbons were constituted substantially only by an amorphous phase. Measurement was carried out with respect to the amount of Al in each mother alloy prepared, the presence of streaks on each ribbon of an iron-based amorphous alloy produced by a single-roller method, and the streaks and brittleness of each ribbon measured by a tearing test. The results are shown in Table 2.

TABLE 2

| No. | Composition (atomic %) | Al in Mother Alloy (ppm) | Appearance of Amorphous ribbon | Brittleness(1) of Amorphous Ribbon (%) |
|---|---|---|---|---|
| EXAMPLE 7 | $Fe_{bal}Nb_7B_9$ | 20 | No streaks | 0 |
| EXAMPLE 8 | $Fe_{bal}Zr_{3.5}Nb_{3.5}B_8$ | 10 | No streaks | 0 |
| EXAMPLE 9 | $Fe_{bal}Cu_1Nb_7B_9$ | 10 | No streaks | 0 |
| EXAMPLE 10 | $Fe_{bal}Cu_1Zr_7B_3$ | 5 | No streaks | 0 |
| EXAMPLE 11 | $Fe_{bal}Cu_1Zr_{3.5}Nb_{3.5}B_8$ | 20 | No streaks | 0 |

Table 2 shows that the ribbons of the present invention had an Al content of 50 ppm or less without streaks and brittleness, regardless of composition.

EXAMPLES 12–15

Raw materials comprising electrolytic iron, scrap copper, scrap silicon, ferroniobium containing 65 mass % of Nb and 1 mass % of Al as a source of Nb, ferroboron containing 18 mass % of B and 0.2 mass % of Al as a source of B, and an oxide selected from the group consisting of $Fe_2O_3$, CuO, $SiO_2$ and $B_2O_3$ having a smaller standard free energy of formation than that of $Al_2O_3$ in an absolute value were formulated to a composition comprising 1 atomic % of Cu, 2 atomic % of Nb, 11 atomic % of Si, and 9 atomic % of B, the balance being substantially Fe and inevitable impurities, The amount of each of $FE_2O_3$, CuO, $SiO_2$ and $B_2O_3$ was shown in mass % in Table 3. The raw materials were melted together in a crucible by induction heating to form a mother alloy melt having a composition capable of forming a nanocrystalline structure having an average crystal grain size of about 10 nm. After removing $Al_2O_3$ formed during melting and floating on the melt, an alloy melt was poured into a mold to form a mother alloy.

Each mother alloy melt was formed into a ribbon by using a single-roller quenching apparatus. Each mother alloy was introduced into a crucible to melt it by a high-frequency induction heating, and the resultant mother alloy melt was ejected through a nozzle having a rectangular slit onto a cooling roller made of a copper alloy, thereby rapidly solidifying it to form a ribbon of 100 mm in width and 25 $\mu$m in thickness.

The X-ray diffraction of the resultant ribbons revealed that all ribbons were constituted substantially only by an amorphous phase. Measurement was carried out with respect to the amount of Al in each mother alloy prepared, the presence of streaks on each ribbon of an iron-based amorphous alloy produced by a single-roller method, and the streaks and brittleness of each ribbon measured by a tearing test. The results are shown in Table 3.

All of the amorphous alloy ribbons formed from mother alloys prepared with the oxides had an Al content of 50 ppm or less, free from streaks on the surface and high brittleness, regardless of the types of the oxides used.

EXAMPLE 16

Raw materials comprising electrolytic iron, scrap copper, scrap silicon, ferroniobium containing 63 mass % of Nb and 0.4 mass % of Al as a source of Nb, and ferroboron containing 17 mass % of B and 0.02 mass % of Al as a source of B were formulated to a composition comprising 1 atomic % of Cu, 2.5 atomic % of Nb, 13.5 atomic % of Si, and 7.5 atomic % of B, the balance being substantially Fe and inevitable impurities, and melted in a crucible by induction heating to form a mother alloy melt. This alloy has a composition capable of forming a nanocrystalline structure having an average crystal grain size of about 10 nm. An oxygen gas was blown into the melt in a crucible for oxygen refining to form a slag based on $Al_2O_3$. After removing the slag, an alloy melt was ejected through a nozzle having a rectangular slit onto a cooling roller made of a copper alloy in a single-roller quenching apparatus, thereby rapidly solidifying it to form a ribbon of 25 mm in width and 10 $\mu$m in thickness.

The X-ray diffraction of the resultant ribbons revealed that all ribbons were constituted substantially only by an amorphous phase. The Al content in the melt was 30 ppm, and the amorphous alloy ribbon formed by a single-roller method was free from surface streaks and brittleness at all.

EXAMPLE 17–19

Raw materials comprising electrolytic iron, scrap silicon, granular nickel, ferroniobium containing 65 mass % of Nb and 0.5 mass % of Al, ferroboron containing 17 mass % of B and 0.01 mass % of Al, and $Fe_2O_3$ were formulated to have compositions shown in Table 4, and melted in a crucible by induction heating to provide mother alloys. All of these alloys had compositions capable of forming amorphous alloys. They were melted together with 0.2 mass % of

TABLE 3

| | Oxide Added | | | | |
|---|---|---|---|---|---|
| No. | Type | Mass % | Al in Mother Alloy (ppm) | Appearance of Amorphous Ribbon | Brittleness(1) of Amorphous Ribbon (%) |
| EXAMPLE 12 | $Fe_2O_3$ | 0.25 | 30 | No streaks | 0 |
| EXAMPLE 13 | CuO | 0.20 | 20 | No streaks | 0 |
| EXAMPLE 14 | $SiO_2$ | 0.10 | 50 | No streaks | 0 |
| EXAMPLE 15 | $B_2O_3$ | 0.30 | 10 | No streaks | 0 |

$Fe_2O_3$ based on the mother alloy melt. After removing a floating slag based on $Al_2O_3$, the melt was poured into a mold to form a mother alloy.

Each mother alloy melt was formed into a ribbon by using a single-roller quenching apparatus. Each mother alloy was introduced into a crucible to melt it by a high-frequency induction heating, and the resultant mother alloy melt was ejected through a nozzle having a rectangular slit onto a cooling roller made of a copper alloy, thereby rapidly solidifying it to form a ribbon of 50 mm in width and 50 $\mu$m in thickness.

The X-ray diffraction of the resultant ribbons revealed that all ribbons were constituted substantially only by an amorphous phase. Measurement was carried out with respect to the amount of Al in each mother alloy prepared, the presence of streaks on each ribbon of an iron-based amorphous alloy produced by a single-roller method, and the streaks and brittleness of each ribbon measured by a tearing test. The results are shown in Table 4.

TABLE 4

| No. | Composition (atomic %) | Al in Mother Alloy (ppm) | Appearance of Amorphous Ribbon | Brittleness(1) of Amorphous Ribbon (%) |
|---|---|---|---|---|
| EXAMPLE 17 | $Fe_{bal}Si_9B_{13}$ | 5 | No streaks | 0 |
| EXAMPLE 18 | $Fe_{bal}Nb_4Si_5B_{12}$ | 20 | No streaks | 0 |
| EXAMPLE 19 | $Fe_{bal}Ni_{10}Nb_5Si_5B_{16}$ | 20 | No streaks | 0 |

All of the mother alloys of EXAMPLES 17–19 had an Al content of 50 ppm or less, and the amorphous alloy ribbons formed therefrom were free from surface streaks and brittleness, regardless of compositions.

EXAMPLE 20

Raw materials comprising electrolytic iron, scrap copper, scrap silicon, ferroniobium containing 66 mass % of Nb and 0.9 mass % of Al as a source of Nb, ferroboron containing 17.5 mass % of B and 0.04 mass % of Al as a source of B, and $Fe_2O_3$ were formulated to a composition comprising 0.6 atomic % of Cu, 2.6 atomic % of Nb, 7.5 atomic % of Si, and 10 atomic % of B, the balance being substantially Fe and inevitable impurities, and melted in a crucible by induction heating to form a mother alloy melt. This alloy has a composition capable of forming a nanocrystalline structure having an average crystal grain size of about 10 nm. The melt was prepared in a crucible together with 0.4 mass % of $Fe_2O_3$ based on the mother alloy melt. An oxygen gas was blown into the melt in the crucible for oxygen refining to form a floating slag based on $Al_2O_3$. After removing the floating slag, an alloy melt was poured into a mold to form a mother alloy.

The mother alloy was melted and ejected through a nozzle having a rectangular slit onto a cooling roller made of a copper alloy in a single-roller quenching apparatus, thereby rapidly solidifying it to form a ribbon of 200 mm in width and 50 $\mu$m in thickness.

The X-ray diffraction of the resultant ribbons revealed that all ribbons were constituted substantially only by an amorphous phase. The Al content in the melt was 20 ppm, and the amorphous alloy ribbons formed by a single-roller method were free from surface streaks and brittleness at all.

As described above, the iron-based amorphous alloy ribbons formed from the mother alloys produced by the method of the present invention have a low Al content, thus substantially free from nonferrous inclusions of $Al_2O_3$, sites at which embrittlement starts in the ribbons streaks and brittleness. Accordingly, the iron-based amorphous alloy ribbons are substantially free from surface streaks and brittleness and thus can provide toroidal coils with excellent magnetic properties because of a high packing factor.

Because inexpensive ferroalloys such as ferroniobium can be used, the method of the present invention can produce amorphous alloy ribbons and nanocrystalline alloy ribbons at low cost.

What is claimed is:

1. A method for producing a mother alloy for an iron-based amorphous alloy, comprising the steps of (a) melting raw materials for elements constituting said amorphous alloy together with at least one oxide of an element constituting said amorphous alloy, said raw materials containing aluminum as an inevitable impurity, $Al_2O_3$ being formed from said aluminum during said melting, and said oxide having a smaller standard free energy of formation than that of $Al_2O_3$ in an absolute value; and (b) removing the resultant $Al_2O_3$ from said melt, thereby reducing the content of aluminum to 50 ppm or less in said melt.

2. The method for producing a mother alloy for an iron-based amorphous alloy according to claim 1, wherein ferroniobium is used as one of said raw materials for elements constituting said amorphous alloy.

3. The method for producing a mother alloy for an iron-based amorphous alloy according to claim 1, wherein said oxide is at least one of iron oxide, copper oxide, silicon oxide and boron oxide.

4. The method for producing a mother alloy for an iron-based amorphous alloy according to claim 2, wherein said oxide is at least one of iron oxide, copper oxide, silicon oxide and boron oxide.

5. The method for producing a mother alloy for an iron-based amorphous alloy according to claim 3, wherein said oxide is $Fe_2O_3$.

6. The method for producing a mother alloy for an iron-based amorphous alloy according to claim 4, wherein said oxide is $Fe_2O_3$.

7. A method for producing a mother alloy for an iron-based amorphous alloy, comprising the steps of (a) melting raw materials for elements constituting said amorphous alloy to form a melt, said raw materials containing aluminum as an inevitable impurity; (b) blowing an oxygen-based gas into or onto said melt, $Al_2O_3$ being formed from said aluminum during said blowing; and (c) removing the resultant $Al_2O_3$ from said melt, thereby reducing the content of aluminum to 50 ppm or less in said melt wherein ferroniobium is used as one of said raw materials for elements constituting said amorphous alloy.

8. The method for producing a mother alloy for an iron-based amorphous alloy according to claim 7, wherein at least one oxide of an element constituting said amorphous alloy is used together with said raw materials for elements constituting said amorphous alloy, said oxide having a smaller standard free energy of formation than that of $Al_2O_3$ in an absolute value.

9. The method for producing a mother alloy for an iron-based amorphous alloy according to claim 8, wherein said oxide is at least one of iron oxide, copper oxide, silicon oxide and boron oxide.

10. The method for producing a mother alloy for an iron-based amorphous alloy according to claim 9, wherein said oxide is $Fe_2O_3$.

* * * * *